US005079837A

United States Patent [19]

Vanselow

[11] Patent Number: 5,079,837

[45] Date of Patent: Jan. 14, 1992

[54] REPAIR LINING AND METHOD FOR REPAIRING A HEAT EXCHANGER TUBE WITH THE REPAIR LINING

[75] Inventor: Walter Vanselow, Heroldsbach-Thurn, Fed. Rep. of Germany

[73] Assignee: Siemes Aktiengesellschaft, Munich, Fed. Rep. of Germany

[21] Appl. No.: 488,715

[22] Filed: Mar. 5, 1990

[30] Foreign Application Priority Data

Mar. 3, 1989 [DE] Fed. Rep. of Germany ... 8902572[U]

[51] Int. Cl.[5] ..... B21D 53/00

[52] U.S. Cl. ..... 29/890.31; 29/402.09; 29/402.15; 29/523; 29/890.036; 138/97; 138/98; 165/76

[58] Field of Search ..... 29/157.3 R, 157.3 C, 29/157.3 V, 402.09, 402.15, 523, 890.031, 890.036; 165/76, 906; 138/89, 97, 98

[56] References Cited

U.S. PATENT DOCUMENTS

| | | | |
|---|---|---|---|
| 4,182,408 | 1/1980 | Laber | 165/76 |
| 4,283,615 | 8/1981 | Vrillon | 165/76 |
| 4,573,248 | 3/1986 | Hackett | 29/402.09 |
| 4,581,801 | 4/1986 | Kobuck et al. | 29/402.09 |
| 4,598,738 | 7/1986 | Weber et al. | 165/76 |
| 4,649,989 | 3/1987 | Vermaat et al. | 165/76 |
| 4,713,870 | 12/1987 | Szalvay | 29/402.09 |
| 4,724,899 | 2/1988 | Frates et al. | 165/76 |

FOREIGN PATENT DOCUMENTS

| | | |
|---|---|---|
| 0047407 | 3/1982 | European Pat. Off. . |
| 0120277 | 10/1984 | European Pat. Off. . |
| 0181250 | 4/1988 | European Pat. Off. . |
| 3212223 | 8/1984 | Fed. Rep. of Germany . |

*Primary Examiner*—Irene Cuda

*Attorney, Agent, or Firm*—Herbert L. Lerner; Laurence A. Greenberg

[57] ABSTRACT

A repair lining for a heat exchanger tube includes a sleeve having ends. A tubular basic body is disposed in the sleeve and has ends protruding beyond the ends of the sleeve. One of the ends of the basic body has a top part being supported on the sleeve and the other of the ends of the basic body has a thread formed thereon. A nut is disposed on the thread for bracing the repair lining in the heat exchanger tube. At least one clamping ring is disposed on one of the ends of the basic body between the sleeve and the top part, and at least one clamping ring is disposed on the other of the ends of the basic body between the sleeve and the nut. The clamping rings have a conical shape in an initial relaxed condition being changed into a flattened shape with an enlarged diameter by relative motion between the basic body and the sleeve. A method for repairing a heat exchanger tube with a repair lining includes introducing a repair lining into the heat exchanger tube, and tightening the nut with a tool for axially enlarging the clamping rings and substantially fluid-tightly connecting the basic body to the heat exchanger tube.

11 Claims, 1 Drawing Sheet

9
3
1
10
19
15
17
15a
17
15b
5
7
21
4
18
15b
17
15a
17
15
19
13
11
23

9
3
1
19
15
17
15a
17
15b
5
7
4
18
15b
17
15a
17
15
19
13
25
11
23

9
3
1
10
15c
21
5
7
4
18
15b
15a
17
15e
19
13
24
11
21

REPAIR LINING AND METHOD FOR REPAIRING A HEAT EXCHANGER TUBE WITH THE REPAIR LINING

The invention relates to a repair lining and a method for repairing a heat exchanger tube with a repair lining having a sleeve with a tubular basic body protruding through it at both ends, one end of the basic body having a top part being supported on the sleeve, the other end of the basic body having a thread, and a nut on the thread for bracing the lining in the heat exchanger tube.

Published European Application No. 0 120 277 discloses a three-part repair assembly for heat exchanger tubes, that is formed of a cylindrical sleeve having end surfaces chamfered on the inside, and a tubular basic body which is passed through the cylindrical body, has a top part on one end, and is provided on the other end with a thread. A clamping ring is inverted over the end of the basic body provided with the thread and rests with a collar on the tube bottom. It is brought into engagement with the oblique end surfaces of the cylindrical sleeve with its opposite end surface. Once the repair assembly has been inserted into the heat exchanger tube, the cylindrical sleeve is upset by tightening a nut located on the thread and pressed into tight engagement with the tubes to be repaired, in the vicinity of both end surfaces. Such a device can only be used in the vicinity of the tube bottom. Moreover, the repair configuration cannot be used more than once, because the upsetting deforms the cylindrical sleeve.

Published European Application No. 0 181 250 also discloses the insertion of a tubular lining into a heat exchanger tube. The lining is first retained by expanding with rollers in the heat exchanger tube and then is additionally soldered firmly in place. A similar method is known from Published European Application No. 0 047 407, but here the lining is expanded by pressure and subsequently welded firmly into place. Later removal of such linings from the heat exchanger tube can be achieved only with great difficulty.

Instead of repairing a damaged heat exchanger tube by means of a repair lining, German Patent DE-PS 32 12 223 discloses the closure of the tube with a tube stopper. This takes the heat exchanger tube out of operation. The tube stopper is provided with cuff rings on the periphery thereof. It must withstand very high pressures under certain circumstances during operation. In order to be capable of withstanding the forces exerted on the cuff rings, they must be very large and must have a wide deployment angle.

It is accordingly an object of the invention to provide a repair lining and a method for repairing a heat exchanger tube with the repair lining, which overcome the hereinaforementioned disadvantages of the heretofore-known methods and devices of this general type, which is simple to manufacture and which is reliable in operation.

With the foregoing and other objects in view there is provided, in accordance with the invention, a repair lining for a heat exchanger tube, comprising a sleeve having ends, a tubular basic body being disposed in the sleeve and having ends protruding beyond the ends of the sleeve, one of the ends of the basic body having a top part being supported on the sleeve and the other of the ends of the basic body having a thread formed thereon, a nut disposed on the thread for bracing the repair lining in the heat exchanger tube, at least one clamping or cuff ring being disposed on one of the ends of the basic body between the sleeve and the top part, and at least one clamping or cuff ring being disposed on the other of the ends of the basic body between the sleeve and the nut, the clamping or cuff rings having a conical shape in an initial relaxed condition being changed into a flattened shape with an enlarged diameter by relative motion between the basic body and the sleeve.

The structure of the invention is a particularly simple version of a repair lining, which has only a few, simply manufactured individual parts and has many uses.

In accordance with another feature of the invention, the top part is a flange.

In accordance with a further feature of the invention, the at least one clamping ring at least on one of the ends of the basic body is in the form of a plurality of clamping rings, and there are provided spacer rings separating the clamping rings from one another.

In accordance with an added feature of the invention, the at least one clamping ring at least on one of the ends of the basic body is in the form of a plurality of clamping rings disposed directly alongside one another.

In accordance with an additional feature of the invention, the at least one clamping ring includes two clamping rings being mutually offset by 180° in the relaxed conical condition thereof.

In accordance with yet another feature of the invention, two of the conical clamping rings are disposed on and face away from one another in the form of a double clamping ring.

In accordance with yet a further feature of the invention, there are provided means associated with the basic body for force-locking engagement of a tool.

In accordance with yet an added feature of the invention, there are provided means associated with the nut for insertion of a tool.

With the objects of the invention in view, there is also provided a method for repairing a heat exchanger tube with a repair lining, the repair lining including a sleeve having ends, a tubular basic body being disposed in the sleeve and having ends protruding beyond the ends of the sleeve, one of the ends of the basic body having a top part being supported on the sleeve and the other of the ends of the basic body having a thread formed thereon, a nut disposed on the thread for bracing the repair lining in the heat exchanger tube, at least one clamping ring being disposed on one of the ends of the basic body between the sleeve and the top part, and at least one clamping ring being disposed on the other of the ends of the basic body between the sleeve and the nut, the clamping rings having a conical shape in an initial relaxed condition being changed into a flattened shape with an enlarged diameter by relative motion between the basic body and the sleeve; and the method comprising introducing a repair lining into the heat exchanger tube, and tightening the nut with a tool for axially enlarging the clamping rings and substantially fluid-tightly and force-lockingly connecting the basic body to the heat exchanger tube.

Other advantageous embodiments of the invention are disclosed in the dependent claims.

Other features which are considered as characteristic for the invention are set forth in the appended claims.

Although the invention is illustrated and described herein as embodied in a repair lining and a method for repairing a heat exchanger tube with the repair lining, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figures 1, 2, 3:
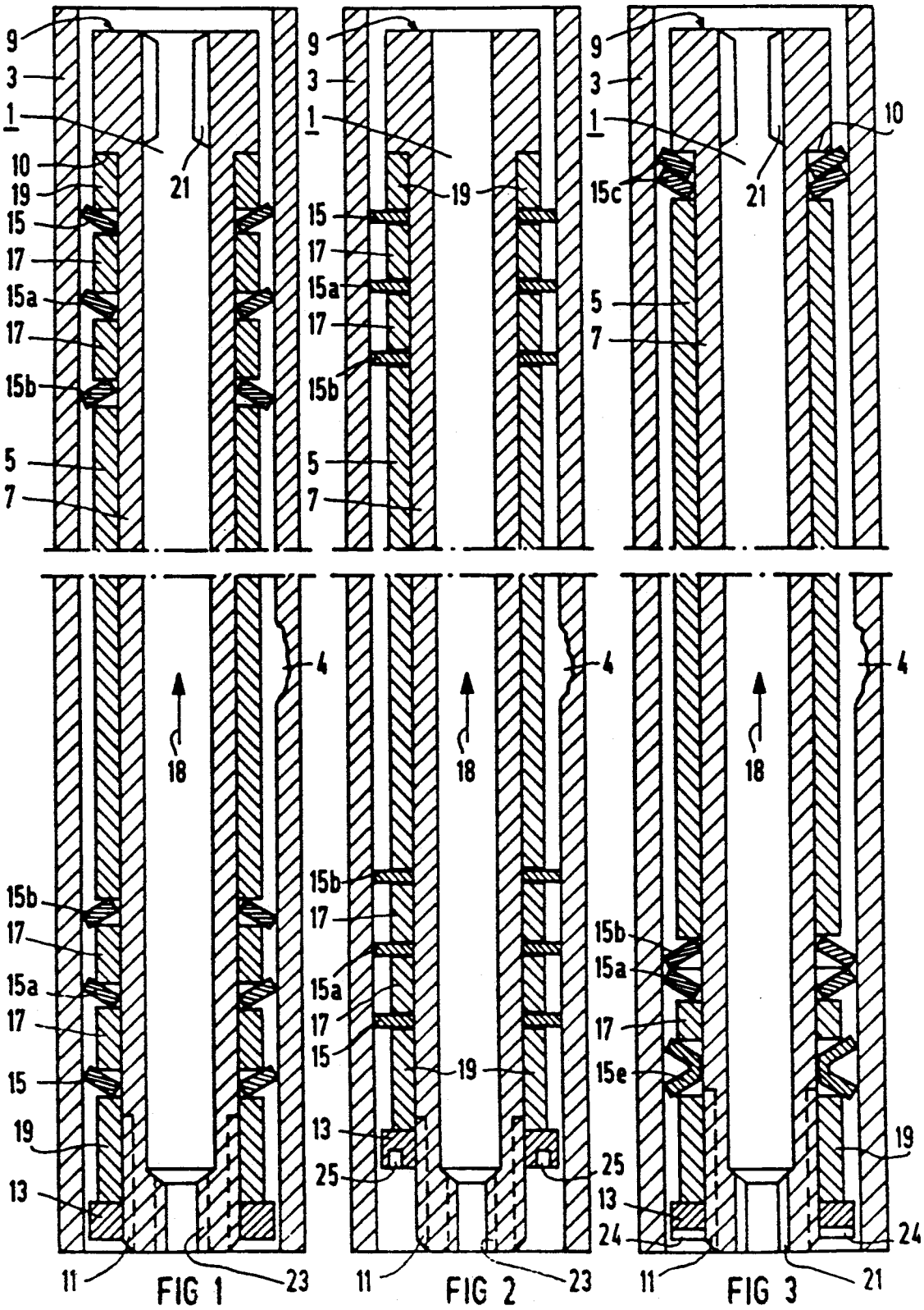
FIG. 1 is a fragmentary, diagrammatic, longitudinal-sectional view of a repair lining introduced into a heat exchanger tube, shown in a relaxed state.
FIG. 2 is a view similar to FIG. 1 of the repair lining of FIG. 1 in a tensioned state.
FIG. 3 is a fragmentary, longitudinal-sectional view of another repair lining with double cuff rings, shown in the tensioned state.

Referring now to the figures of the drawing in detail and first, particularly, to FIG. 1 thereof, there is seen an insertable repair lining, filler or insert 1 that is introduced into a defective heat exchanger tube 3. The heat exchanger tube 3 has a defective point 4 that is to be sealed off or protected. The repair lining 1 has a cylindrical sleeve 5 through which a tubular basic body 7 protrudes. The basic body is indirectly supported on one end of the sleeve 5 by a thickened top part 9 thereof. The other end of the basic body 7 is provided with a thread 11 and a nut 13 for bracing the repair lining 1 in the heat exchanger tube 3. At least one respective plate-like clamping or cuff ring 15 is provided between the sleeve 5 and the top part 9, as well as between the sleeve 5 and the nut 13. The cuff rings are manufactured of metal in particular, such as spring steel. The cuff rings 15 have a frustoconical (or conical) shape as seen in section. The diameter of the cuff rings 15 can be enlarged by compression in the axial direction. This compression is accomplished in the illustrated repair lining 1 by tightening the nut 13. The nut 13 may be in the form of a hexagonal nut, as shown. In that case the tightening is accomplished with a box end wrench. Other versions are also possible, for instance using a slit nut or a nut provided with bores or recesses. Even with such a nut, tightening can be performed from outside the end of the tube 3 using a suitable tool.

It is advantageous for the top part 9 to be constructed as a flange with an annular support surface 10. In this way, strong bracing forces can be attained with the repair lining 1. It is also advantageous to provide a plurality of cuff rings 15, 15*a*, 15*b* on each end of the sleeve 5, which are separated from one another by spacer rings 17. In this case, three cuff rings 15, 15*a*, 15*b* are provided on each end, as an example. In this way, less force is exerted upon the heat exchanger tube 3 per cuff ring 15, 15*a*, 15*b* by the repair lining 1, with the same bracing, than when there is only one cuff ring 15. This also improves heat transfer from medium 18 flowing through the tube to the heat exchanger tube 3. An additional support ring 19 can also be provided on each end.

Advantageously, two elastically deformable clamping or cuff rings 15*a*, 15*b* are provided on each end and are offset from one another by 180° (also seen in FIG. 3) in the relaxed conically-shaped condition thereof. As a result, when the repair lining 1 is braced, axial displacement of the repair lining 1 in the heat exchanger tube 3 can be prevented.

The repair lining 1 is dimensioned in such a way that on one hand the sleeve 5 and the spacer rings 17 are not deformed during bracing and on the other hand the inside diameter of the basic body 7 is as large as possible, so that the flow of the medium 18 therethrough is hindered as little as possible.

FIG. 2 shows the repair lining 1 in the tensioned state. The cuff rings 15, 15*a*, 15*b* have been compressed by tightening the nut 13. The cuff rings therefore have a flattened shape and are enlarged in diameter. As a result, the repair lining 1 is joined to the heat exchanger tube 3 in a force-locking manner. A force-locking connection is one which connects two elements together by forcing external to the elements, as opposed to a form-locking connection which is provided by the shapes of the elements themselves. A marked sealing capacity or sealing action is also attained by means of the contact surface of the cuff rings 15, 15*a*, 15*b*. This becomes particularly important if the heat exchanger tube 3 is already leaking at the point 4.

In the repair lining of FIG. 3, two cuff rings 15*c* are advantageously disposed directly beside one another at one end on the top part 9. As a result, the repair lining 1 has particularly good sealing ability. With this double configuration, the cuff rings 15*c* can be made particularly thin and can have a large inside diameter, which permits enlargement of the inside diameter of the repair lining 1.

On the other end of the repair lining 1, as shown in FIG. 3, two cuff rings 15*a*, 15*b* are disposed offset from one another by 180°, in their relaxed conical condition. They are disposed apart from one another, between the sleeve 5 and the spacer ring 17. When this kind of configuration is braced, an abatement of axial forces between the repair lining 1 and the heat exchanger tube 3 and particularly uniform force distribution are attained. Furthermore, spacer rings can be dispensed with.

This kind of embodiment of cuff or clamping rings 15*a*, 15*b*, which are also called V-section rings, can be provided by simple means by using only one double cuff ring 15*e*, which is constructed from two conical cuff rings disposed on and facing away from one another. This is advantageous if particularly strong retaining forces in the heat exchanger tube are to be attained.

With these V-shaped configurations, the V shape of the cuff ring 15*e*, or of the cuff rings 15*a*, 15*b*, can point selectively outward or inward. Configurations and combinations of the cuff ring 15, 15*a*, 15*b*, 15*c*, 15*e* that go beyond the versions shown here can also be provided.

In order to prevent rotation of the repair lining 1 about its longitudinal axis during the bracing in the heat exchanger tube 3, it is advantageous to provide means on the basic body 7 for establishing a force-locking connection or retention for an inserted tool. These means may, for instance, be in the form of a hexagon socket 21 (as seen in FIG. 3). As already mentioned above, in this version the nut 13 is provided with a slit 24, which permits the engagement of a suitable tool for tightening or loosening the nut 13. However, other versions of the nut are also possible, such as an internal thread 23, as shown in FIGS. 1 and 2. As FIG. 2 shows, the nut 13 can also be provided with bores 25 that permit access by a mandrel-like tool. As shown, the connection means can be selectively provided on the top and/or end, and in various versions.

The illustrated repair lining 1 is simple to manufacture. It is also inexpensive to manufacture. It enables shortening of assembly times, which in turn results in a reduced radiation exposure to humans, if heat exchanger tubes 3 exposed to radiation in a nuclear power reactor, are to be repaired. In the illustrated repair lining 1, since no heat is introduced into the material of the repair lining 1 or the heat exchanger tube 3 by welding or soldering, there is comparatively low vulnerability to corrosion. Moreover, the repair lining 1 is removable and can be used more than once. No special cleaning of the heat exchanger tube 3 before insertion of the repair lining 1 is necessary.

If the repair lining 1 is used in the region near the bottom of a heat exchanger, then a combination of bracing techniques and welding or soldering techniques is also possible. To this end, the repair lining 1 can be braced in the upper, inaccessible region of the heat exchanger tube 3 and secured at the lower end by welding or soldering.

I claim:

1. Method for repairing a heat exchanger tube with a repair lining, the repair lining including:

a hollow sleeve having ends, a tubular basic body for conducting fluid disposed in the sleeve and having ends protruding beyond the ends of the sleeve, one of the ends of the basic body having a top part being supported on the sleeve and the other of the ends of the basic body having a thread formed thereon, a nut disposed on the thread for bracing the repair lining in the heat exchanger tube, at least one first clamping ring being disposed on one of the ends of the basic body between the sleeve and the top part, and at least one second clamping ring being disposed on the other of the ends of the basic body between the sleeve and the nut, the clamping rings having a conical shape in an initial relaxed condition being changed into a flattened shape with an enlarged diameter by relative motion between the basic body and the sleeve, the repair lining being movable along the interior of the heat exchanger tube such that the defect is disposed between the first and second clamping rings and sealed off from the ends of the basic body, the method comprising:

introducing the repair lining into the heat exchanger tube, and tightening the nut with a tool for axially enlarging the clamping rings and substantially fluid-tightly connecting the basic body to the heat exchanger tube.

2. Method for repairing a heat exchanger tube with a repair lining, the repair lining including:

a hollow sleeve, a hollow basic body for conducting fluid in the sleeve having a part supported on the sleeve and a thread opposite the part, a nut on the thread, at least one first clamping ring being disposed on the basic body between the sleeve and the top part, and at least one second clamping ring being disposed on the basic body between the sleeve and the nut, the clamping rings having a conical shape in an initial relaxed condition being changed into a flattened shape with an enlarged diameter by relative motion between the basic body and the sleeve, the repair lining being movable along the interior of the heat exchanger tube such that the defect is disposed between the first and second clamping rings and sealed off from the ends of the basic body, the method comprising:

introducing the repair lining into the heat exchanger tube, and tightening the nut with a tool for axially enlarging the clamping rings and substantially fluid-tightly connecting the basic body to the heat exchanger tube.

3. Repair lining for a heat exchanger tube having an interior and a surface defect, comprising a hollow sleeve, a hollow basic body for conducting fluid in said sleeve having a part supported on said sleeve and a thread opposite said part, a nut on said thread, at least one first clamping ring being disposed on said basic body between said sleeve and said top part, and at least one second clamping ring being disposed on said basic body between said sleeve and said nut, said first and second clamping rings having a conical shape in an initial relaxed condition being changed into a flattened shape with an enlarged diameter by relative motion between said basic body and said sleeve, said repair lining being movable along the interior of said heat exchanger tube such that the defect is disposed between said first and second clamping rings and sealed off from said ends of said basic body.

4. Repair lining for a heat exchanger tube having an interior and a surface defect, comprising a hollow sleeve having ends, a tubular basic body for conducting fluid disposed in said sleeve and having ends protruding beyond said ends of said sleeve, one of said ends of said basic body having a top part being supported on said sleeve and the other of said ends of said basic body having a thread formed thereon, a nut disposed on said thread for bracing the repair lining in the heat exchanger tube, at least one first clamping ring being disposed on one of said ends of said basic body between said sleeve and said top part, and at least one second clamping ring being disposed on the other of said ends of said basic body between said sleeve and said nut, said first and second clamping rings having a conical shape in an initial relaxed condition being changed into a flattened shape with an enlarged diameter by relative motion between said basic body and said sleeve, said repair lining being movable along the interior of said heat exchanger tube such that the defect is disposed between said first and second clamping rings and sealed off from said ends of said basic body.

5. Repair lining according to claim 4, wherein said top part is a flange.

6. Repair lining according to claim 4, wherein at least one of said first and second clamping rings is in the form of a plurality of clamping rings, and including spacer rings separating said clamping rings from one another.

7. Repair lining according to claim 4, wherein at least one of said first and second clamping rings is in the form of a plurality of clamping rings disposed directly alongside one another.

8. Repair lining according to claim 4, wherein at least one of said first and second clamping rings includes two clamping rings being mutually offset by 180° in the relaxed conical condition thereof.

9. Repair lining according to claim 4, wherein at least one of said first and second clamping rings is in the form of a double clamping ring having a V-shaped cross-section.

10. Repair lining according to claim 4, including means associated with said basic body for force-locking engagement of a tool.

11. Repair lining according to claim 4, including means associated with said nut for insertion of a tool.

* * * * *